US005311623A

United States Patent [19]

Hendi

[11] Patent Number: 5,311,623

[45] Date of Patent: May 17, 1994

[54] HYDROPNEUMATIC MATTRESS

[76] Inventor: Elias A. M. Hendi, Callao 25 5th Floor "K", Buenos Aires, Argentina

[21] Appl. No.: 962,267

[22] Filed: Oct. 16, 1992

[51] Int. Cl.[5] ..... A47C 27/10; A61G 7/04

[52] U.S. Cl. ..... 5/450; 5/455

[58] Field of Search ..... 5/449, 452, 455

[56] References Cited

U.S. PATENT DOCUMENTS

| | | | |
|---|---|---|---|
| 779,576 | 1/1905 | Berryman | 5/455 |
| 2,691,179 | 10/1954 | Kann | 5/450 |
| 3,766,579 | 10/1973 | Shields | 5/452 X |
| 3,772,717 | 11/1973 | Yuen et al. | 5/450 X |
| 4,079,473 | 3/1978 | Phillips | 5/450 X |
| 4,193,149 | 3/1980 | Welch | 5/450 X |
| 4,945,588 | 8/1990 | Cassidy et al. | 5/451 |
| 4,999,867 | 3/1991 | Toivio et al. | 5/455 |
| 5,010,608 | 4/1991 | Barnett et al. | 5/455 X |
| 5,090,077 | 2/1992 | Caden et al. | 5/455 X |

*Primary Examiner*—Michael F. Trettel
*Attorney, Agent, or Firm*—Lucas & Just

[57] ABSTRACT

A hydropneumatic mattress with upper water containing tubes and lower air containing tubes is disclosed. The upper and lower tubes are supported by a layer. The tubes are individually removable for replacement. The mattress construction is especially desirable because it is articulatable along its length.

2 Claims, 1 Drawing Sheet

FIG. 1
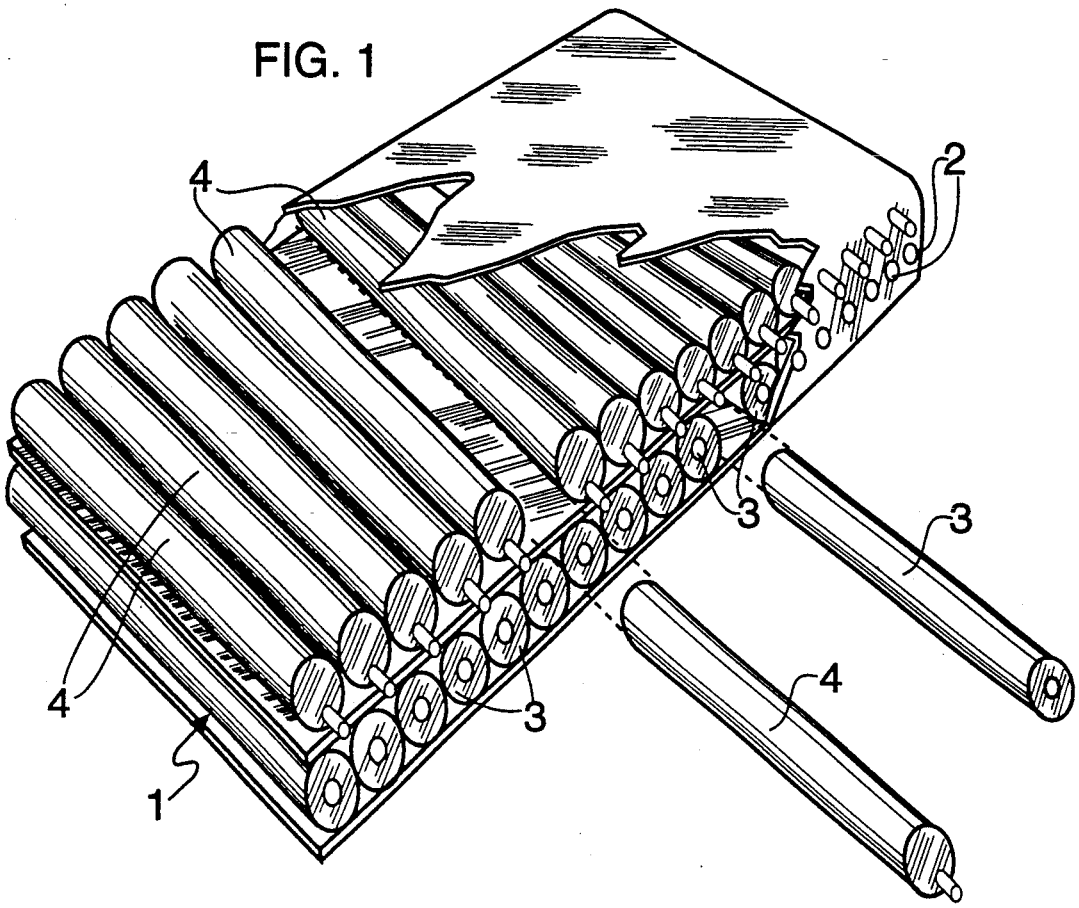
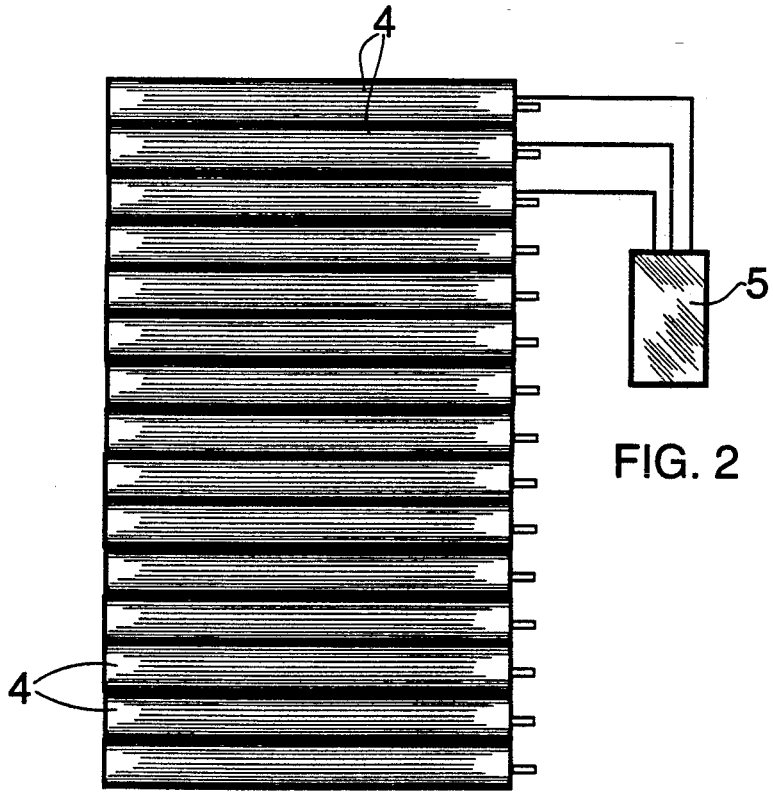
FIG. 2

HYDROPNEUMATIC MATTRESS

This invention relates to a "*HYDROPNEUMATIC MATTRESS*". The main object of the present invention is to provide a mattress that will join the advantages of a pneumatic mattress to those of an hydraulic mattress, and taking advantage of the benefits that come through "hydropneumatic compensation", resulting from a correct inter-relation of the forces produced between fluid and gaseous elements in interaction.

Essentially, this invention is an hydraulic mattress of adjustable capacity, placed over a pneumatic mattress, of equally adjustable capacity, both units interrelated according to the user's needs.

Both units have been designed with an "internal structure", and therefore do not require external form containers or other complementary elements.

The principal advantages of this invention are the homogeneity and indeformability that the mattress presents, since both the pneumatic body, and the hydraulic body consist of interrelated independent removable elements which provide a combined hydropneumatic compensation among each section.

Another advantage of this invention is that pneumatic and hydraulic fluids can be increased or removed individually or in combined elements, to increase prostration hardness or softness for patients with eschar problems.

This procedure is very important for use in hospitals, for it ensures the complete adaptation of this mattress to orthopedic beds, since it adapts to inclining and leaning movements of orthopedic beds, without losing any of its inherent qualities.

A further advantage of this invention is that it provides users with the benefits of prostration on a liquid element with a very reduced volume of liquid (heavy element), and a larger volume of gaseous element (light element). In this way, "the total weight of the mattress" is substantially reduced, in opposition to the heavier weight of the conventional water mattress.

A further advantage of this invention is that pneumatic and hydraulic fluids can be removed or increased individually, or in combined elements, modifying the hydropneumatic compensation, increasing hardness or softness of the mattress according to the user's resting needs. This operation can be carried out by manual means or by automatic commands. This operation can be carried out as a treatment in itself, producing the effects of a therapeutic massage for the resting body.

A further advantage is that the mattress provides the user, especially prostrate patients, with the possibility of receiving kinesitherapeutic massage by individual, in series or combined inflation or deflation or the elements, which is beneficial for the patient's recovery and well-being.

A further object of importance of this invention is that the mattress insures effective prevention to patient's eschar problems, since modifications of superficial pressures of the mattress, provide resting pressures on the patient's body.

Likewise, the mattress can be extremely positive for treatment of patients who already present eschars, who can also benefit by this system to activate blood circulation.

This activation can also be carried out by rhythmic manual pulsation of any of the elements composing the mattress. This produces internal fluid movements which, in the manner of waves, rhythmically massage the resting body.

A further advantage of this invention is the fact that it allows application of passive exercising to prostrate patients.

Previously described procedures of variation of fluids contained in independent elements, can be carried out with the liquid containers as well as with the air-containers. Variations with air-containing elements are preferred, since air is easily impelled from or expelled to the atmosphere.

Specialists and users may add other advantages to those we have briefly summarized.

An embodiment of an example of the invention, in which exclusive property is claimed, will be described in the following, reference being made to the accompanying drawings, to non-determinate scale. Being an example, it is expressly made clear that protection assigned to the present invention will not have an exclusive or limitative character. This example merely indicates an explicative and illustrative intention for the basic lines that this invention comprises.

Accompanying drawings are defined as follows:

FIG. 1 Shows the hydropneumatic mattress of this invention, inflated, in a general perspective view, showing pneumatic and hydraulic elements removed for replacement.

FIG. 2 Is a plan view of the hydropneumatic mattress of this invention showing the pneumatic body of the mattress, with each element connected to a programmable central command.

With the purpose of establishing a relation between the drawings and the descriptive relation that follows, we have assigned a common number of reference to the parts or similar elements that appear in the drawings.

The hydropneumatic mattress of the present invention in which exclusive property is claimed, comprises a pneumatic base mattress 1, with a series of retention valves 2, corresponding to respective interior elements 3 (FIG. 1). Placed over base mattress 1 covering the total surface of this mattress, is the upper layer of base mattress 1, formed by removable water containing elements (FIG. 1).

It is understood that, in certain cases, the mattress may be used upside down, that is, with the pneumatic base 1 as the upper layer, and the water-containing elements 4, down.

Each containing element may be replaced by a similar one in case of leaks (FIG. 1). This is one of the most outstanding advantages of this mattress.

Each retention valve 2, of the pneumatic elements 3, may be connected to each individual command valve, so as to operate inflation or deflation of pneumatic elements 3 from the central command 5.

This offers prostrate patients the possibility of either fixed special modulation of the mattress, or programable alternative inflation-deflation, providing automatic massage, as desired according to the patient's needs.

This invention is used following a simple procedure: the deflated mattress is spread out on the bed, hospital trolley, floor, etc. The following step requires inflating or filling pneumatic and hydraulic elements as correspond.

Next, as the patient lies on the mattress, there is an internal adjustment of hydraulic and pneumatic pressures. The mattress does not go out of shape as a result of its internal structures, formed by individual sections. However, if resulting pressure produces a surface that is too hard or too soft in relation to the patient's needs, the inlet or outlet of fluids in each element will regulate pressure according to the desired results. This regulation can be made either manually or automatically.

Likewise, circulation of warm or cold fluids can be made by manual or automatic means, in accordance to the patient's specific needs, incorporating necessary heating or refrigerating devices.

This hydropneumatic mattress also provides an alternative use, for particular or specific use which may be considered convenient, positioning the mattress upside down, that is, using the gaseous layer as the upper surface and the liquid layer as the bottom surface.

It is also established that the hydropneumatic mattress of this invention is normally used as a conventional mattress, without adding other devices, comprising only its series of hydropneumatic elements, which adapt to the user's needs, and where all other devices are subsidiary and complementary.

According to the description and reference made to accompanying drawings, constructive and functional advantages are clearly outlined, characterizing the present invention. It is considered unnecessary to extend explanation referred to the HYDROPNEUMATIC MATTRESS, except for the fact that the inventor claims exclusive rights to introduce subsequent modifications of details within the limits of the following claims.

We claim an exclusive property or privilege in the invention, which has been described and determined as follows:

1. A hydropneumatic mattress having a length and a width and with the length being greater than the width, said hydropneumatic mattress comprising:

a top layer;

an intermediate flexible impervious layer a bottom layer;

a plurality of air containing tubes situated between said bottom and intermediate layers, said air containing tubes extending transversely of the mattress across its width;

a plurality of water containing tubes situated between said intermediate and top layers, said water containing tubes extending transversely of the mattress across its width;

each said water containing tube being positioned directly above an air containing tube;

each said water containing tube and each said air containing tube being individually removable from said mattress;

each said air containing tube having a valve to enable adjustment of the amount of air in each said air containing tube;

each said water containing tube having a valve to enable adjustment of the amount of water in each said water containing tube; and said mattress when in use being articulatable along its length.

2. The hydropneumatic mattress of claim 1 further including means for inflation and deflation of the said air containing tubes.

* * * * *

UNITED STATES PATENT AND TRADEMARK OFFICE

CERTIFICATE OF CORRECTION

PATENT NO. : 5,311,623

DATED : May 17, 1994

INVENTOR(S) : Elias A.M. Hendi

It is certified that error appears in the above-identified patent and that said Letters Patent is hereby corrected as shown below:

Column 4, line 5, delete "flexible impervious".

Signed and Sealed this

Thirtieth Day of August, 1994

*Attest:*

*Attesting Officer*

Bruce Lehman

BRUCE LEHMAN

*Commissioner of Patents and Trademarks*